United States Patent [19]

Deussen et al.

[11] Patent Number: 4,926,915

[45] Date of Patent: May 22, 1990

[54] AMPUL

[75] Inventors: Heino Deussen; Werner Deussen, both of Eltville, Fed. Rep. of Germany

[73] Assignee: Stella KG Werner Deussen, Eltville, Fed. Rep. of Germany

[21] Appl. No.: 220,593

[22] Filed: Jul. 18, 1988

[30] Foreign Application Priority Data

Jun. 1, 1988 [DE] Fed. Rep. of Germany ..... 3818682

[51] Int. Cl.[5] ..... B65B 3/10; A61J 1/06

[52] U.S. Cl. ..... 141/290; 141/18; 141/319; 604/200; 604/232; 215/32

[58] Field of Search ..... 141/18, 21, 29, 25–27, 141/285, 290, 309, 310, 312, 114, 319, 346, 363–366, 383; 222/541; 604/87, 200, 905, 244, 403, 416, 405, 232; 239/309; 215/32

[56] References Cited

U.S. PATENT DOCUMENTS

| | | | |
|---|---|---|---|
| 1,254,655 | 1/1918 | Carpenter | 215/32 |
| 1,487,824 | 3/1924 | Vincent | 141/310 |
| 1,641,328 | 9/1927 | Ferdinand | 141/18 |
| 1,651,963 | 12/1927 | Mooney | 141/310 |
| 2,668,533 | 2/1954 | Evans | 604/405 |
| 2,878,808 | 3/1959 | Broman | 604/416 |
| 3,182,861 | 5/1965 | Nataf | 222/541 |
| 3,667,657 | 6/1972 | Chiquiari-Arias | 222/541 |
| 3,777,949 | 12/1973 | Chiquiari-Arias | 222/541 |
| 4,134,511 | 1/1979 | Deussen | 215/32 |
| 4,295,495 | 10/1981 | Rosemeier | 604/905 |
| 4,338,980 | 7/1982 | Schwebel et al. | 141/18 |

FOREIGN PATENT DOCUMENTS

| | | | |
|---|---|---|---|
| 0800455 | 8/1958 | United Kingdom | 604/87 |

*Primary Examiner*—Henry J. Recla
*Assistant Examiner*—Casey Jacyna
*Attorney, Agent, or Firm*—H. Gibner Lehmann; K. Gibner Lehmann

[57] ABSTRACT

An ampul comprising a container having a reduced neck which supports an integral closure part that is removable by tearing away frangible portions. The neck can be sealingly applied over the seating cone of a hypodermic syringe whereby the syringe and ampul are firmly joined as one unit. The ampul is preferably produced as a single piece of a thermoplastic synthetic such as polypropylene whereby the ampul neck has sufficient elastic ductility to be elastically expanded by applying it to the seating cone of the syringe, thereby to assure a firm coherence. To permit air to enter to container when suctioning off the ampul contents, the ampul neck has on its inside an axial ventilating means.

13 Claims, 7 Drawing Sheets

AMPUL

BACKGROUND OF THE INVENTION

FIELD OF THE INVENTION

This invention relates to ampoules which accommodate a dose of liquid medium for transfer into hypodermic syringes, and more particularly to ampoule containers of the type having necks with predetermined frangible portions or breaking points and handles for effecting openings at the breaking points.

DESCRIPTION OF THE RELATED ART INCLUDING INFORMATION DISCLOSED UNDER 37 CFR §§1.97–1.99

Until now, ampoules of this kind were usually made of glass the ampoule neck being fused shut at its free end after the ampoule was filled, to provide a tight closure. To open such an ampoule, the user had to score the ampoule neck wall at a suitable point with an ampoule cutter and then break off the fused section of the neck in order to be able to introduce into the opening thus formed a hollow needle attached to the head or seating cone of hypodermic syringe.

Also already known in the art are glass ampoules in which a predetermined breaking point is preformed by scoring the ampoule neck wall and then covering or securing the same by a masking tape. In still other known glass ampoules a predetermined breaking point is formed at the ampoule neck through special heat treatments, whereby an annular wall area is formed with internal tensions in the glass. In this latter type of glass ampoule, prescoring by the user is obviated. All that is needed is to apply a force so as to break off the ampoule neck portion that was closed by the fusing, said neck portion serving as the handle.

All known glass ampoules, however, have in common the drawback that, when breaking off part of the ampoule neck, glass particles are apt to get into the ampoule content. Additionally, the necks of all glass ampoules with predetermined breaking points ca break off inadvertently or prematurely due to external influence so that the ampoule is then opened unintentionally, making its content unfit for use.

Glass ampoules further have the additional drawback that the head of the administering device (e.g. the seating cone of the hypodermic syringe) forms no firm seat with the ampoule neck port that remains on the ampoule vessel or container. Therefore, transferring the ampoule content to the administering device, i.e. drawing the content into the hypodermic syringe requires special dexterity which must often be accomplished by means of the previously attached hypodermic needle. This is not only particularly time-consuming but it also can impair the sterility of the hypodermic needle.

From the above reasoning, it is also already known, e.g. from U.S. Patent No. 3,667,657 to Chiquiar-Arias, to provide syringes for one use only, in which the syringe cylinder including the seating cone for a hollow needle is made in the manner of a plastic ampoule that is closed by the syringe piston at the end opposite to the ampoule neck. The closed portion of the ampoule neck has a predetermined breaking point to enable it to be broken at a defined spot whereby the remaining portion can be utilized as a seating cone for the hollow needle. Such throw-away syringes are costly because the syringe cylinder and the piston guided in it must be closely fitted and tight so that the liquid is effectively expelled; but their value is lost after one use. In addition, sealing of the syringe by means of a piston is insufficient for many media, even if the ampoule that is initially designed to constitute a throw-away syringe is given an additional sterile packaging.

Also already known are tubular and ampoule-like dose containers and dispensers, e. g. from U.S. Pat. No. 3,777,949 to Chiquiar-Arias, and U.S. Pat. No. 4,134,511 to Deussen, where a more or less elongated container neck is provided with a predetermined break-off point so it can be opened at its free end. Such containers, however, serve to dispense a liquid medium directly, e.g. for external treatment of the human or animal body or to clean sensitive articles such as contact lenses.

SUMMARY OF THE INVENTION

In contrast to the above, it is an object of the present invention to improve substantially ampoules which serve to supply liquid media intended for transfer into administering devices such as hypodermic syringes, whereby the transfer of the ampoule content to the administering device, e.g. the drawing of the ampoule content into a syringe, is considerably facilitated and made safer.

According to the invention, this problem is solved in that the ampoule neck is constituted of an elastically ductile material and constructed as a push-on and retaining ring or annulus for application to the seating cone of the administering device or syringe, e.g. that syringe portion which is adapted for the attachment of the actual hypodermic needle, and in that a ventilating mechanism, leading into the ampoule interior, is provided What the invention thus achieves is that the ampoule with its ampoule neck can be attached safely and firmly enough for the effective and sanitary transfer of the ampoule content and (apart from the air inlet) also tightly to the administering device or syringe. No longer is the user required to hold or support the ampoule during the transfer of its content into the syringe; instead he merely plugs in the syringe safely into the opened ampoule neck and then holds the syringe with one hand while operating it with the other to suck in the ampoule content. The elastically ductile construction of the ampoule neck represents no major cost increase, especially where the entire ampoule consists of a one-piece, elastically ductile material such as synthetic polypropylene.

In a preferred embodiment of the invention, the ampoule neck supports at its free end a closure part which is integrally connected to the orifice lip portion of the ampoule neck via an annular, predetermined frangible web. The said lip portion of the ampoule neck is constituted as a funnel-shaped lead-in for the cup of a hypodermic needle. It is preferred that the lip portion of the ampoule neck has a rounded edge to form the funnel-shaped lead-in. In this preferred embodiment of the invention, the closure part can be essentially disk-shaped, being disposed within the orifice lip portion and within the predetermined frangible web with the latter annularly surrounding the closure part. The frangible web is arranged so as to be recessed below the lip portion of the ampoule neck.

Also, in a preferred embodiment of the invention, the head end of the administering device, such as the seating cone of a syringe, can be introduced into the orifice lip portion of the ampoule neck with particular safety and simplicity after removal of the closure part. The remnants of the predetermined frangible web that remain upon the removal of the closure part will occupy the outside surface of the head or seating cone, being squeezed against the inner circumference of the ampoule neck so that no separation of plastic particles from these remnants of the predetermined frangible web will occur, for possible contamination of the ampoule content during transfer to the administering device. This is because any particles of the remnants of the frangible web which cling, are pushed radially outward by the outside diameter of the head or seating cone and are prevented from penetrating the interior of the ampoule.

By providing on the ampoule neck a ventilating mechanism which is closed while storing or transporting the ampoule, and which is opened simultaneously with the opening of the ampoule neck when the ampoule is to be used, there is insured an air flow into the ampoule container as the administering device such as a syringe sucks in the liquid ampoule content. This prevents the development of a vacuum inside the ampoule container, which would counteract the aspiration of the liquid ampoule content by the administering device. For the formation of the ventilating mechanism, the ampoule neck can have on its inside a ventilating groove which can extend essentially axially with respect to the ampoule neck.

However, the ventilating mechanism is preferably formed by providing a separate ventilating hole or passage next to or alongside the ampoule neck. In a preferred embodiment of the invention, this ventilating passage can be formed by a ventilating tube which extends parallel to the ampoule neck and has a closure element which can be broken off together or simultaneously with the ampoule neck. In order to prevent the escape of air from the ventilating tube into the ampoule neck with greater certainty, the ampoule tube can be made longer than the actual ampoule neck, extending towards the ampoule interior. The separate ventilating passage which is to be provided next to the ampoule neck can also be located at a thinner, pierceable spot in the wall of the ampoule should It is also possible to mold a ventilating tube into the ampoule shoulder or another ampoule wall part that is separate and spaced from the ampoule neck.

The ampoule according to the invention is preferably intended for use in connection with conventional syringes that are designed for repeated use in the aspiration of the liquid to be administered, and that have a seating cone for the attachment of an injection needle. In view of this intended use it is preferred according to the invention, to form the ampoule neck so that it has a greater axial length than the seating cone of conventional syringes. This assures that the seating cone of a syringe pressed into the mount of the ampoule neck is enclosed thereby in close-fitting fashion. What this achieves is that the entire amount of liquid contained in the ampoule can be sucked into the syringe.

In one preferred embodiment of the invention, the ampoule vessel together with its neck is made in a single piece of thermoplastic synthetic, preferably polypropylene, which is tightly closed at its end opposite the ampoule neck after filling. In this embodiment, the ampoule can be similar to the dose containers disclosed in U.S. Pat. No. 4,134,511 or U.S. Pat. No. 3,777,949. In this one embodiment it can be of particular advantage for the ampoule vessel to be of greater wall thickness in the portion thereof which is adjacent to the ampoule neck, rather than in the portion that is opposite to the neck. This offers the advantage that, when gripping the ampoule by the portion adjacent to the ampoule neck, there is prevented undesirable compression and, hence, inadvertent pressing out of the ampoule content; yet the ampoule can still be gripped firmly. On the other hand, the container wall at the end remote from the ampoule neck can be thin and flexible enough to permit compressing and fusing after the ampoule is filled.

The ampoule vessel can be advantageously produced by injection molding in one piece, having a cylindrical external shape with an open end opposite to the ampoule neck, such molded piece including the ampoule neck and its closure part with handle. The cylindrical external form of the ampoule vessel wall offers the advantage that, on the one hand, all further processing, particularly printing and feeding within the filling and fusing machine is greatly facilitated. On the other hand, the cylindrical outer shape offers the advantage that the unavoidable expansion which takes place at the fusion point during the fusing operation is noticeably less than in ampoules whose vessels are of conical shape. The production of ampoules, according to the invention, having a cylindrical external shape of the vessel portion by injection molding may seem difficult at first. However, the ampoule vessel portion can be produced in such a way that its inside cavity tapers down slightly from the open end towards the ampoule neck and, correspondingly, its wall thickness increases conically from the open end towards the ampoule neck. On the one hand, this facilitates considerably the removal of the ampoule according to the invention from the mold during its production by injection molding, and on the other hand a desired wall thickness of the ampoule vessel with less flexibility in the portion adjacent to the ampoule neck and with more flexibility in the portion away from the ampoule neck is achieved.

If the ampoule according to the invention is fabricated as a single plastic part, the transition from the ampoule vessel portion to the ampoule neck portion can also be carried out in the form of a shoulder, in which blind embossings are provided, e.g. for information on volume and content of the respective ampoule. These blind embossings on the ampoule shoulder automatically come into the user's field of view when he or she grabs the ampoule to open it, and when attaching the ampoule to an administering device. Thus, an additional safeguard is provided in that the ampoule is checked for the right content and the correct amount before it is attached to the administering device. Moreover, the emptied ampoule can be saved as a control measure.

All further data such as batch numbers, production date, expiration date, etc., can be embossed by the jaws of the fusing machine in the resulting fusion seam at the time that the ampoule

BRIEF DESCRIPTION OF THE DRAWINGS

In the accompanying drawings, which illustrate several embodiments of the invention.

DESCRIPTION OF THE PREFERRED EMBODIMENTS

Figure 1:
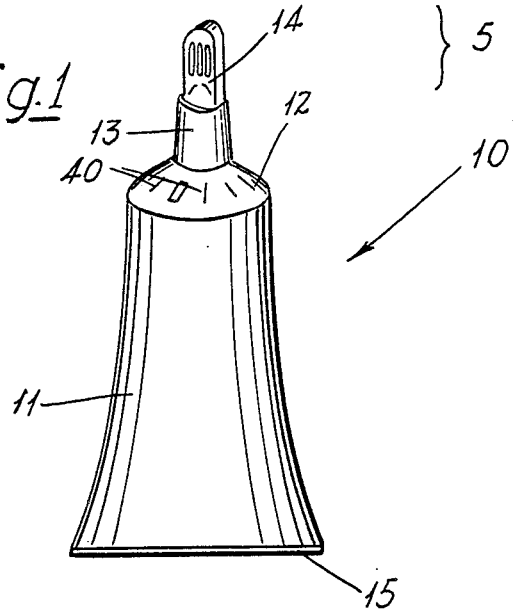
FIG. 1 is a side perspective view of a filled ampoule according to the invention, ready for use.

In the examples shown in the drawings, the ampoule 10 is produced by injection molding as a single thermoplastic part of polypropylene. It has an ampoule vessel or container 11 which transitions into an ampoule neck 13 via an ampoule shoulder 12. Molded on the free end of the ampoule neck 13 is a closure part 14 which is removable by twisting while at the same time breaking and tearing it off. At the end remote from the ampoule neck 13, the circumferential wall of the ampoule vessel 11 is squeezed flat after filling and tightly fused at a closure seam 15.

Due to the entire ampoule 10 being made of polypropylene, the ampoule neck 13 is elastically ductile and constituted as a push-on and retaining ring for the head portion of an administering device. e.g. the seating cone 17 of a syringe 16, said conical head portion or seating cone 17 serving to attach the actual applicator, e.g. a conventional hypodermic needle. As FIGS. 2, 3, 4, 6 and 8 show, the closure part 14 has a disk-shaped portion 18 and an operating or handle portion 19. The disk-shaped portion 18 of the closure part 14 is disposed inside of the orifice lip portion 20 and is integrally connected to the orifice lip portion 20 of the container neck 13 via an annular, predetermined frangible web 21 constituting a zone of weakness which surrounds the circumference of the disk-shaped portion 18. In this manner, the container neck 13 is tightly closed at its free end by the disk-shaped portion 18 of the closure part 14 and the predetermined frangible web 21. The frangible web 21 can be destroyed by twisting, breaking and tearing off the closure part 14. After such removal of the closure part 14, the mount of the ampoule neck 13 is exposed and open. Now the head of an administering device, e.g. the seating cone 17 of a syringe 16, can be plugged into the open end of the ampoule neck 13. To facilitate the safe and smooth introduction of the head or seating cone 17, the orifice lip portion 20 of the ampoule neck is formed to be essentially funnel-shaped towards the inside.

Figure 2:
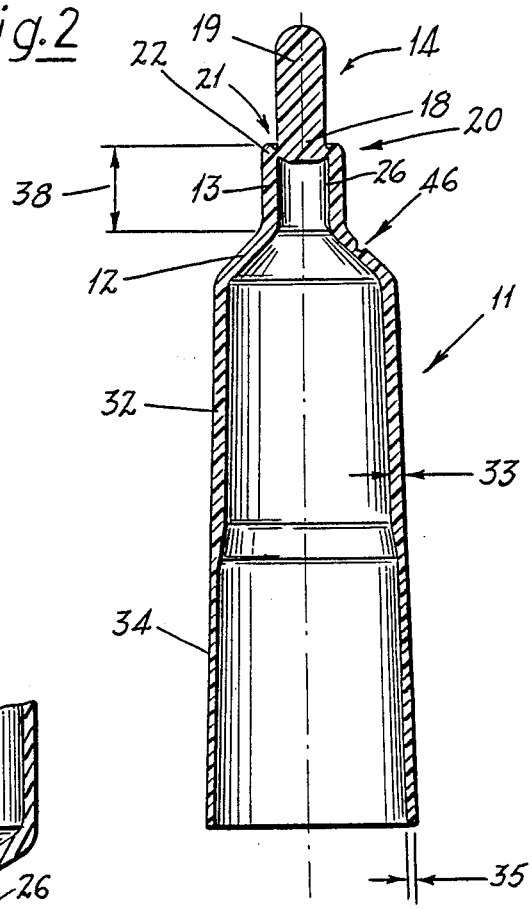
FIG. 2 is an axial section of an ampoule prior to filling, illustrating one embodiment of the invention.
Figure 3:
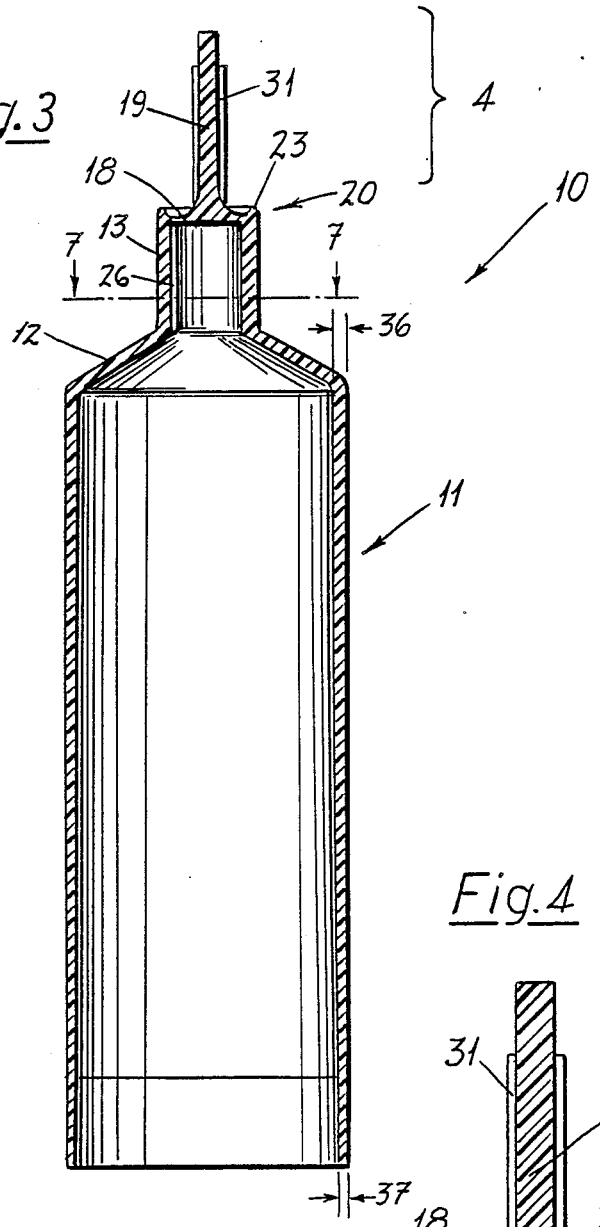
FIG. 3 illustrates in axial section a second embodiment of the invention, showing an ampoule prior to filling.
Figure 4:
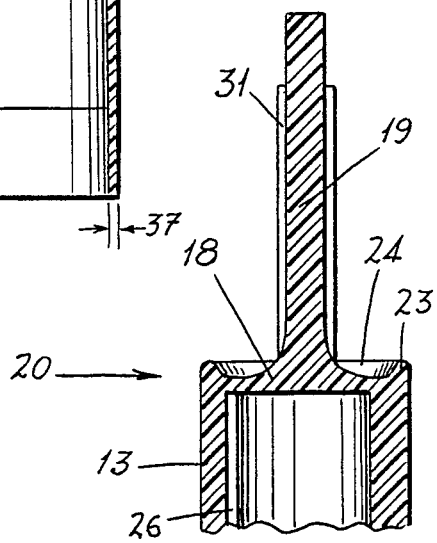
FIG. 4 is a fragmentary section of the area 4 of FIG. 3, in an enlarged representation.
Figure 5:
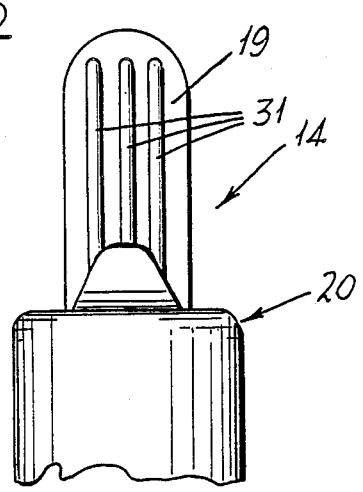
FIG. 5 is a fragmentary showing of the area 5 of FIG. 1, in side view and on a larger scale.
Figure 6:
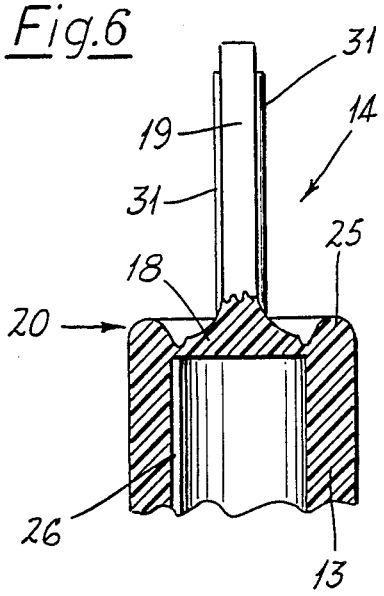
FIG. 6 is a fragmentary axial sectional view of the portion of the ampoule illustrated in FIG. 5.
Figure 7:
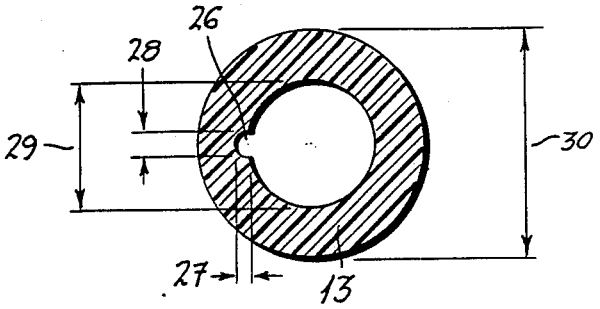
FIG. 7 is a section taken along the line 7—7 of FIG. 3.
Figure 8:
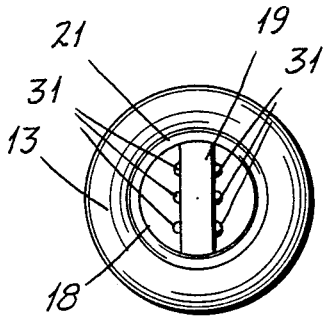
FIG. 8 is an axial top plan view of the ampoule neck with its closure part.

The different embodiments of the invention shown in the drawings depict variations in the shape of the funnel-shaped lead-in 13. In the example of FIG. 2, the actual orifice lip portion 22 of the ampoule neck 13 is arched or rounded with a roughly semi-circular cross-section. In the example of FIGS. 3 and 4, the actual orifice lip portion 23 of the ampoule neck 13 is rounded on the outside and chamfered on the inside, while in the example of FIG. 6 an orifice lip portion 25 with arching is provided whose radius of curvature increases from the outside to the inside, resulting in a more arched funnel inlet than in the example of FIG. 2, or in the conical funnel inlet provided in the example of FIGS. 3 and 4. As FIGS. 2 through 6 show, the predetermined frangible web 21 is recessed in the orifice lip portion 20 of the ampoule neck 13 so that the head of the administering device or seating cone 17 of a syringe 16 is already introduced or guided in the actual orifice lip portions 22, 23, 25 of the ampoule neck 13 before it reaches the remnants of the predetermined frangible web 21.

As FIGS. 2, 3, 4, 6 and 7 show, there is formed in the inside of the ampoule neck 13 a ventilating groove 26 which extends axially and can be of circular arc profile with a depth 27 of e.g. 0.4 mm. and a width of 1.0 mm. The inside diameter 29 of the container neck 13 can be about 4 mm. and the outside diameter about 6 mm.

As FIGS. 3 through 6 and 8 show, the operating portion or handle 19 of the closure part 14 can be constituted in the form of a plate or strap, in order to assure a firm grip for twisting, breaking and tearing off the closure part 14. For further improvement, gripping ribs 31 extending axially can be provided on the operating portion or handle 19.

As FIGS. 2 and 3 show, the ampoule vessel or container 11 in the examples of ampoule 10 illustrated is at first open at its end opposite to or remote from the ampoule neck 13, to enable filling it from this end. In the vicinity of the ampoule neck 13 and ampoule shoulder 12, the circumferential wall of the ampoule vessel 11 is thicker than at its open end.

In the example of FIG. 2, the circumferential wall of the ampoule vessel 11 has a slightly conical shape throughout, expanding towards the open end, and has a portion 32 of greater thickness 33, e.g. about 0.5 mm., adjacent to the ampoule shoulder 12.

In the vicinity of the open end there is a portion 34 of the circumferential wall with a thickness 35 of about 0.35 mm.

In the example of FIG. 3, the circumferential wall of the ampoule vessel 11 is of cylindrical shape on its outside, and its wall thickness decreases from the ampoule shoulder 12 to the open end, namely from a thickness 36 of e.g. 0.55 mm. adjacent to the ampoule shoulder 12, to a thickness 37 of e.g. 0.35 mm. at the open end. This causes the cavity formed in the ampoule vessel 11 before it is closed to taper down from the open end towards the ampoule shoulder 12.

Figure 9:
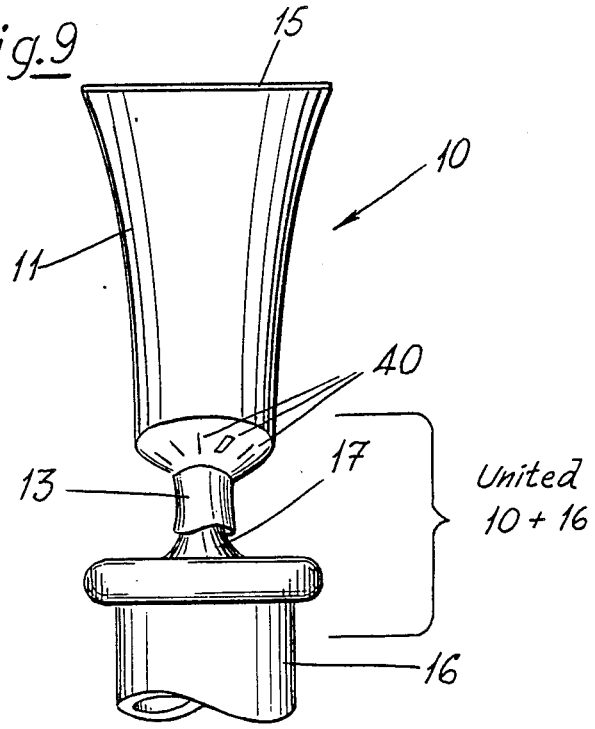
FIG. 9 is a perspective view of an ampoule according to the invention, with a syringe attached to suck in the ampoule content.
Figure 10:
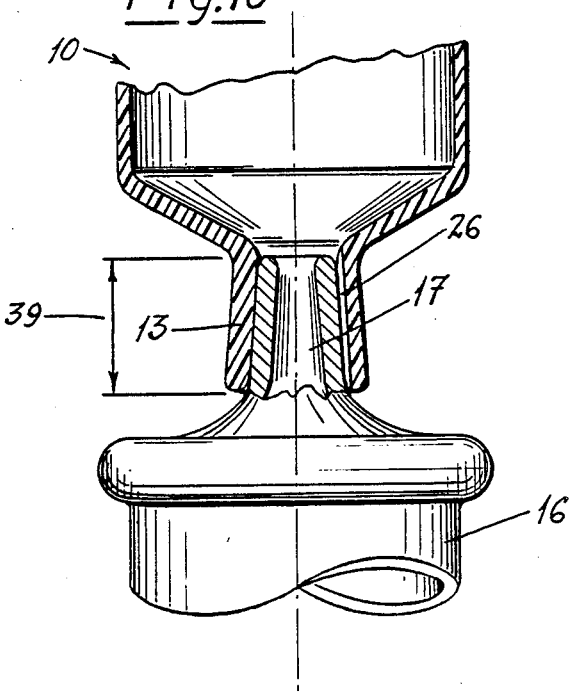
FIG. 10 is an enlarged fragmentary view partly in axial section, of the area 10 of FIG. 9.

As FIGS. 9 and 10 show, when the conical head of an administering device, e.g. the seating cone 17 of a syringe 16, is plugged into the ampoule neck 13, the latter is expanded elastically from its free end so that the inside surface of the ampoule neck 13 attaches firmly to the outside surface of the conical head or seating cone 17. The administering device such as the syringe 16 and the attached ampoule 10 then form a firmly joined unit in which the sucking out of the ampoule content into the administering device is considerably facilitated.

Only the ventilating groove 26 leaves free an axially extending canal between the seating cone 17 and the inside surface of the ampoule neck to admit air while the liquid ampoule content is suctioned off.

As FIGS. 2 and 10 show, the ampoule neck 13 has an axial length 38 which is somewhat greater than the axial length 39 of the administering device head or seating cone 17. This causes the head or seating cone in its plugged-in condition to end within the ampoule neck 13 so that, as is evident from FIG. 10, the entire liquid content of the ampoule 10 can be sucked into the administering device or syringe 16.

As FIGS. 1 and 9 show, there are provided, on the ampoule shoulder 12 of the example illustrated, blind embossings 40 which give information on the content and volume of the ampoule 10. These blind embossings 40 are not likely to be overlooked when opening the ampoule 10 and when introducing the seating cone 17. They are also indelible, thus becoming suitable for use when storing an emptied ampoule 10 as possible proof of medication and the like which has been administered.

Figure 11:
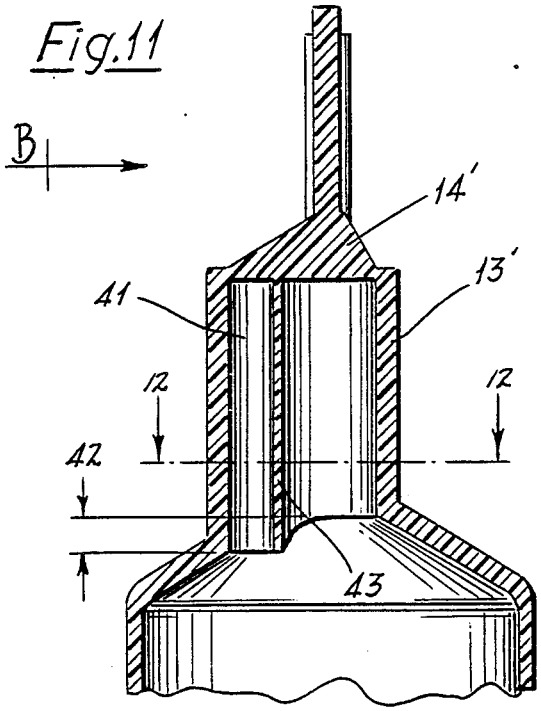
FIG. 11 is a fragmentary axial section of an ampoule showing one preferred embodiment of the invention.

In the preferred embodiment of the invention shown in FIGS. 11 through 14, the ventilating mechanism is formed by a ventilating tube 41 which, while integrally molded to the ampoule neck 13', comprises a separate passage. For the container neck 13' and the ventilating tube 41 one common closure part 14' is formed so that when the closure part 14' is broken off, both the bore of the container neck 13' and the ventilating tube 41 are opened simultaneously. As FIG. 11 shows, the ventilating tube 41 extends parallel to the ampoule neck 13' and ends by a distance 42 deeper in the ampoule interior than the ampoule neck 13' so that the separating wall 43 formed between the ampoule neck 13' and the ventilating tube 41 extends even past the mouth of the ampoule neck 13' into the ampoule interior. The direct entry of air from the ventilating tube 41 to the ampoule neck 13' and thence into the administering device when pulling up the ampoule content is prevented in this manner.

Figure 15:
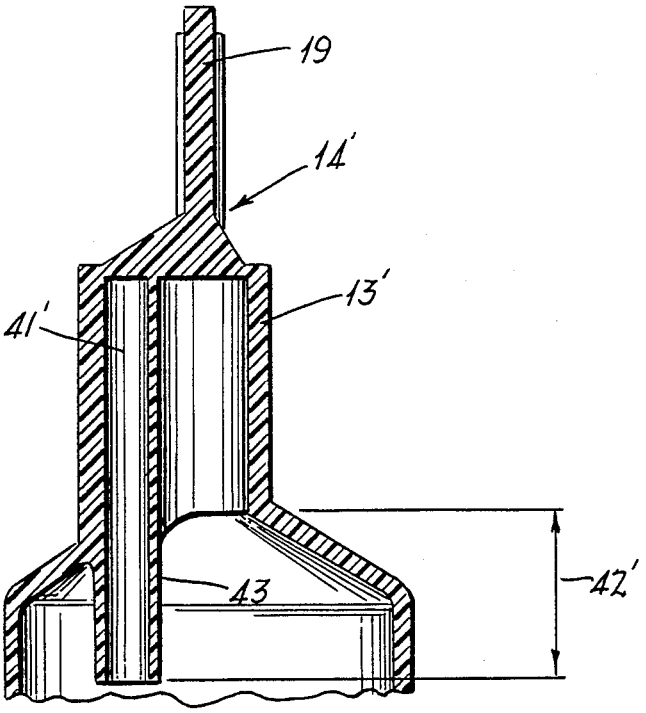
FIG. 15 is a fragmentary axial section of a modified embodiment of the invention.

To prevent the entry of air with even greater certainty, the ventilating tube 41' molded to the ampoule neck 13' and paralleling it in a modified embodiment according to FIG. 15 can also extend into the ampoule interior for a longer distance 42' beyond the ampoule neck 13'.

Figure 12:
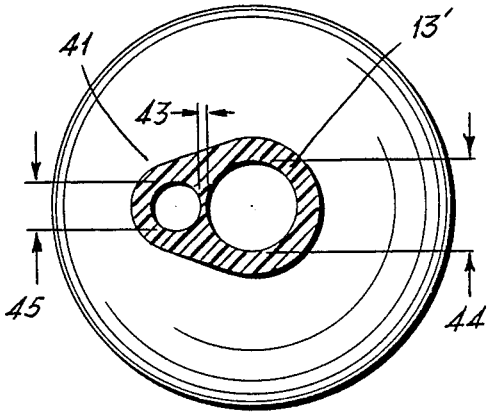
FIG. 12 is a transverse section along the line 12—12 of FIG. 11.
Figure 13:
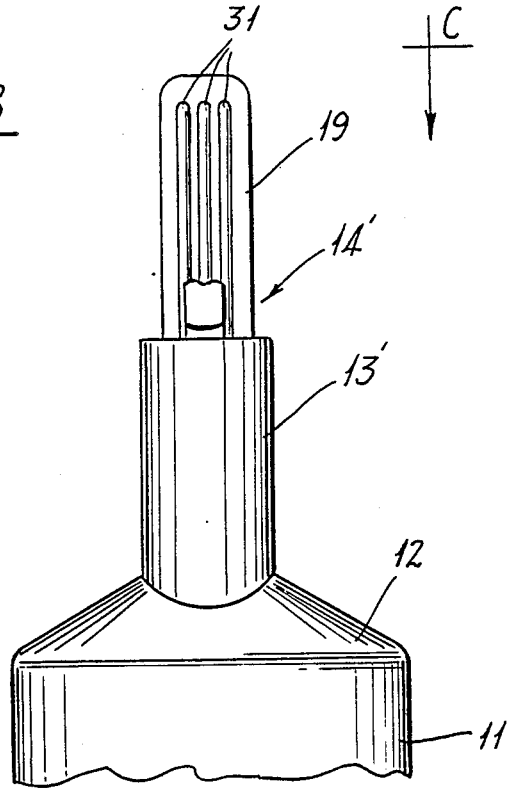
FIG. 13 is a side elevational view of the ampoule according to FIGS. 11 and 12, taken in the sense of the arrow B in FIG. 11.
Figure 14:
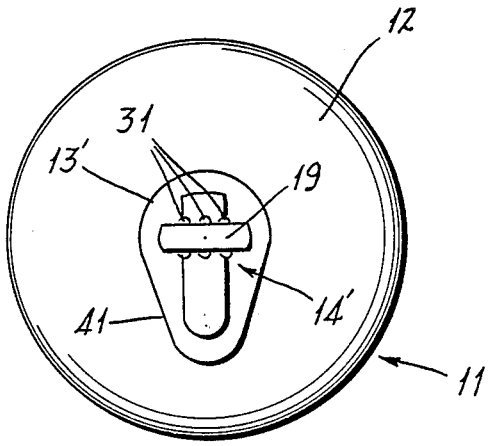
FIG. 14 is a top plan view of the ampoule according to FIGS. 11—13, taken in the sense of the arrow C in FIG. 13.

As FIG. 12 shows, the ventilating tube 41 is formed with a substantially smaller inside cross section than the ampoule neck 13'. For instance, the throat of the ampoule neck 13' may be about twice the diameter 44 of the corresponding diameter 45 of the ventilating tube 41.

Otherwise, the ampoules according to FIGS. 11 through 14 and 15 may have features corresponding to those of the ampoules according to FIGS. 1 through 10, and especially the ampoule according to FIG. 3. This applies, for example, to the closure part 14' which can have a straplike operating part or handle 19 with gripping ribs 31 in a manner corresponding to those in FIGS. 5 and 6.

Instead of the examples illustrated, the ventilating mechanism can also be provided completely separate from the container neck 13 on the ampoule wall, preferably on the ampoule shoulder 12. For example, an easily pierced thin spot could be formed spaced from the ampoule neck 13. This could for instance be a spot indicated in FIG. 2 by the arrow 46. Also, a ventilating tube completely separate from the ampoule neck 13 could be molded into the ampoule shoulder 12 at the spot 46 and could support a closure part which is separate from the ampoule neck 13 and can be broken off independently.

Variations and modifications are possible without departing from the spirit of the invention.

Each and every one of the appended claims defines an aspect of the invention which is separate and distinct from all others, and accordingly it is intended that each claim be treated in this manner when examined in the light of the prior art devices in any determination of novelty or validity.

| List of Reference Symbols | |
|---|---|
| 10 | Ampul |
| 11 | Ampul vessel |
| 12 | Ampul shoulder |
| 13, 13' | Ampul neck |
| 14, 14' | Closure part |
| 15 | Closure seam |
| 16 | Syringe |
| 17 | Seating cone |
| 18 | Disk-shaped part |
| 19 | Handle part |
| 20 | Orifice lip portion |
| 21 | Predetermined frangible web |
| 22 | Orifice edge |
| 23 | Orifice edge |
| 25 | Orifice edge |
| 26 | Ventilating groove |
| 27 | Depth |
| 28 | Width |
| 29 | Inside diameter |
| 30 | Outside diameter |
| 31 | Gripping ribs |
| 32 | Portion adjacent to the shoulder |
| 33 | Thickness |
| 34 | Portion of the circumferential wall |
| 35 | Thickness |
| 36 | Thickness |
| 37 | Thickness |
| 38 | Axial length |
| 39 | Axial length |
| 40 | Blind embossing |
| 41 | Ventilating tube |
| 42, 42' | Distance |
| 43 | Separating wall |
| 44 | Diameter |
| 45 | Diameter |
| 46 | Arrow |

What is claimed is:

1. A one-piece ampoule adapted to accommodate a dose of a liquid medium for transfer to a hypodermic syringe, said ampoule comprising a container and a tubular neck integral with the container, said neck comprising elastically ductile material and being constituted in the form of a push-on annular retainer means for encircling and directly engaging and sealing with the conical seating cone of a hypodermic syringe, which seating cone is intended to be later received in the cup of a hypodermic needle, said neck having a discharge opening therein and an integrally formed vent opening coextensive with said discharge opening but separated therefrom by an elongate wall common to both the said discharge opening and said vent opening, and an integral break-away cover normally sealing both said discharge opening and said vent opening, said integral cover having integrally formed manually engageable handle means to enable the cover to be forcibly broken away to simultaneously permanently uncover both said discharge opening and said vent opening of the ampoule, and to thereafter permit flow of the liquid medium out through the discharge opening while air can simultaneously flow into the ampoule through the separate vent opening.

2. The invention as set forth in claim 1, and further including:

(a) a reinforcing projection integrally formed on said cover, merging with the manually engageable handle means to stiffen the same.

3. The invention as set forth in claim 1, and further including:

(a) a pair of reinforcing projections integrally formed on said cover, merging with the manually engageable handle means to stiffen the same.

4. The invention as set forth in claim 1, wherein:

(a) said handle means is elongate and extends axially of the neck of the container on the side of the cover opposite to the discharge opening and the vent opening.

5. The invention as set forth in claim 1, wherein:

(a) said integral cover is molded to the neck at a zone of weakness characterized by an arcuate frangible web of reduced thickness compared to that of the neck, said zone of weakness bordering both the said discharge opening and the said vent opening.

6. The invention as set forth in claim 1, wherein:

(a) said integral cover is molded to the neck at a zone of weakness characterized by an annular frangible web of reduced thickness compared to that of the neck, said zone of weakness surrounding both the said discharge opening and the said vent opening.

7. The invention as set forth in claim 1, wherein:

(a) said handle means is a solid projection.

8. Ampoule according to claim 1, characterized in that said neck has a ventilating tube which constitutes said vent opening, said ventilating tube being longer than the ampoule neck and extending inward toward the interior of the ampoule.

9. Ampoule according to claim 1, and further including a hypodermic syringe having a seating cone, characterized in that the ampoule neck is of greater axial length than the seating cone of said hypodermic syringe.

10. Ampoule according to claim 1, characterized in that the ampoule container and ampoule neck are constituted of synthetic thermoplastic, and after the container is filled, it is sealed off at the end thereof opposite the ampoule neck.

11. Ampoule according to claim 10, characterized in that the ampoule container is of greater wall thickness at portions adjacent to the ampoule neck than at other portions.

12. Ampoule according to claim 1, characterized in that, after filling, the ampoule container is squeezed flat at the end thereof which is opposite to the ampoule neck in the manner of a collapsible tube, and is tightly fused in a seam extending transversely.

13. Ampoule according to claim 1, characterized in that there is formed, as a transition from the ampoule container to the ampoule neck, an ampoule shoulder in which blind embossings are provided to give information as to the volume and content of the ampoule.

* * * * *